US008074463B2

(12) United States Patent
Bang

(10) Patent No.: US 8,074,463 B2
(45) Date of Patent: Dec. 13, 2011

(54) OUTSIDE AIR PREVENTION FOR A REFRIGERATOR EVAPORATOR

(75) Inventor: Seon Wook Bang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 806 days.

(21) Appl. No.: 12/125,161

(22) Filed: May 22, 2008

(65) Prior Publication Data

US 2009/0000326 A1 Jan. 1, 2009

(30) Foreign Application Priority Data

May 23, 2007 (KR) ..... 10-2007-0050374

(51) Int. Cl.
*F25D 21/14* (2006.01)

(52) U.S. Cl. ..... 62/285; 62/291

(58) Field of Classification Search ..... 62/279, 62/280, 285, 291, 272, 288, 449; 137/247.25, 137/247.29, 247.33, 247.49, 247.39, 592
See application file for complete search history.

(56) References Cited

U.S. PATENT DOCUMENTS 2,485,115 A * 10/1949 Saunders ..... 62/150
3,696,632 A * 10/1972 Carlin et al. ..... 62/285
4,023,380 A * 5/1977 Drouin ..... 62/279

FOREIGN PATENT DOCUMENTS

CA 703567 * 2/1965
JP 2001056175 A * 2/2001

OTHER PUBLICATIONS

JP 2001056175 A (Machine Translation).*

* cited by examiner

*Primary Examiner* — Mohammad Ali
(74) *Attorney, Agent, or Firm* — Birch, Stewart, Kolasch & Birch, LLP

(57) ABSTRACT

The present invention relates to a blocking element which prevent outside air from introducing into an evaporator while operating a refrigerator, wherein defrost water is prevented from freezing at a connection between a drain pan and a drain hose, as outside air is introduced into the evaporator.

10 Claims, 5 Drawing Sheets

OUTSIDE AIR PREVENTION FOR A REFRIGERATOR EVAPORATOR

CROSS REFERENCES RELATED APPLICATIONS

The present application claims priority under 35 U.S.C. 119 and 35 U.S.C. 365 to Korean Patent Application No. 10-2007-0050374 (filed on May 23, 2007), which is hereby incorporated by reference in its entirety.

BACKGROUND

1. Field

This document relates to a refrigerator with a structure for preventing outside air from introducing into an evaporator.

2. Description of the Related Art

FIG. 1 is a side cross-sectional view showing a conventional refrigerator.

Referring to FIG. 1, the conventional refrigerator includes a main body 1, a storage chamber 3 provided in the main body 1, a door 5 for opening/closing the storage chamber 3, an evaporator 10 provided at the rear of the storage chamber 3, a cooling fan 15 for transferring cold air produced in the evaporator 10 to the storage chamber 3, a defrost heater 18 provided at the evaporator 10, a drain pan 21 having the shape of a funnel F provided at a lower portion of the evaporator 10, a drain hose 24 connected to the drain pan 21 in order to guide and discharge defrost water collected in the drain pan 21 to a bottom of the refrigerator, a collecting tray 27 provided at the bottom of the main body 1 to collect defrost water which is flowed along the drain hose 24.

According to this construction, in case the evaporator 10 continues to carry out an operation for producing cold air for a predetermined time, frost is formed on the evaporator 10. And, defrost water is produced, as the defrost heater 18 is operated to remove the frost. The defrost water is discharged to the collecting tray 27 via the drain pan 21 and drain hose 24. Here, the movement of refrigerant into the evaporator 10 is blocked during the defrost process.

If the defrost process is completely finished, cold air is produced as refrigerant is re-introduced into the evaporator 10, and the cold air is blown into the storage chamber 3 as the cooling fan 15 rotates. Here, if the cooling fan 15 rotates, outside air of room temperature may be introduced into the evaporator 10 through an outlet of the drain hose 24. And, the introduced outside air is contacted with cold air in the vicinity of the drain pan 21.

Here, since the outside air contains a specific amount of moisture, the moisture is condensed by contacting it with cold air. Further, if the storage chamber 10 is a freezing chamber, the condensed water droplet is frozen at a neck of the drain pan 21 due to the temperature of cold air. Accordingly, the water droplet to be frozen blocks a discharge passage of defrost water, so that defrost water is not smoothly discharged when carrying out the defrost operation.

The present invention is derived to resolve the above conventional problems, and an object of the present invention is to provide a refrigerator which allows defrost water to be discharged smoothly by preventing outside air from introducing toward an evaporator.

SUMMARY

To achieve the objects of the present invention, as embodied and broadly described herein, there is provided a refrigerator, comprising: a main body in which a food storage chamber is provided; a door pivotably provided at a front of the main body to selectively open/close the storage chamber; an evaporator installed at a rear of the storage chamber; a drain pan provided below the evaporator to receive condensed water; a collecting tray provided at a bottom of the main body to store condensed water collected in the drain pan; a drain hose extended from the drain pan to guide condensed water to the collecting tray; and a blocking element into which an outlet end of the drain hose is inserted to prevent outside air from being introduced into the drain hose.

In another aspect of the present invention, there is provided a refrigerator, comprising: a main body where a machine room for accommodating a compressor and a condenser is provided at a bottom portion; an evaporator provided in the main body to produce cold air; a drain pan provided below the evaporator to receive condensed water; a collecting tray provided at a bottom portion of the machine room to store condensed water collected in the drain pan; a drain hose extended from the drain pan to guide condensed water to the collecting tray; and a blocking element protruded at a bottom of the collecting tray to collect the condensed water, wherein an outlet end of the drain hose is immersed into the condensed water which is collected in the blocking element to prevent outside air from being introduced into the evaporator.

In accordance with the refrigerator of the present invention, since outside air is prevented from introducing into the evaporator while operating the refrigerator, water is advantageously prevented from freezing onto a defrost water discharge passage. Further, as freezing phenomena is prevented, defrost water or condensed water is freely discharged.

DETAILED DESCRIPTION OF THE EXEMPLARY EMBODIMENTS

Hereinafter, the preferred embodiments of the present invention will be explained in detail with reference to the accompanying drawings. It is to be pointed out that the embodiments of the present invention do not limit the scope of the invention, but on the contrary it has to be understood that many modifications, additions, variations or substitutions may be resorted to the present invention, without altering its spirit or departing from its scope of protection, as it is defined in the appended claims.

Figure 1:
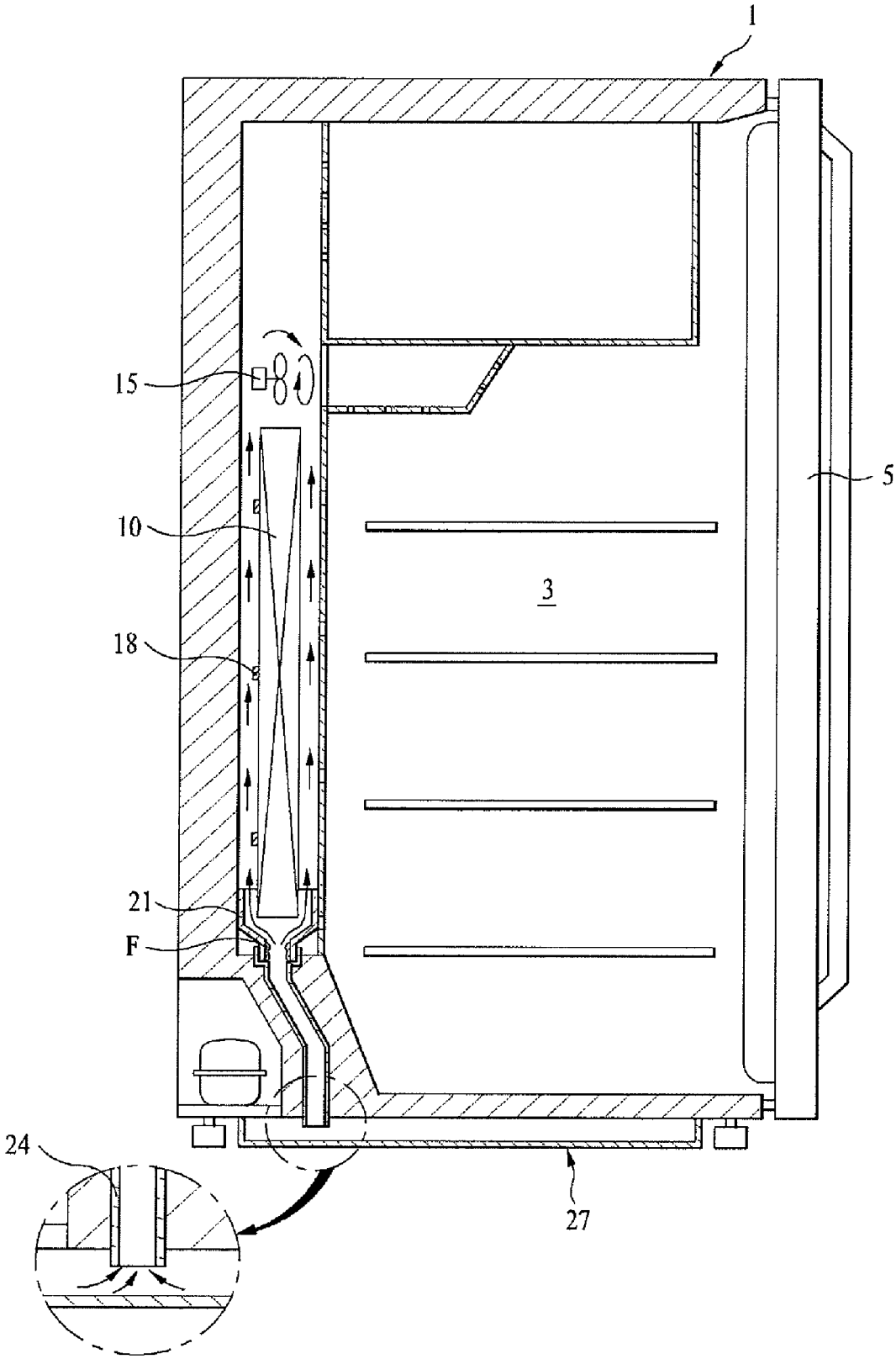
FIG. 1 is a side cross-sectional view showing a structure of a conventional refrigerator.
Figure 2:
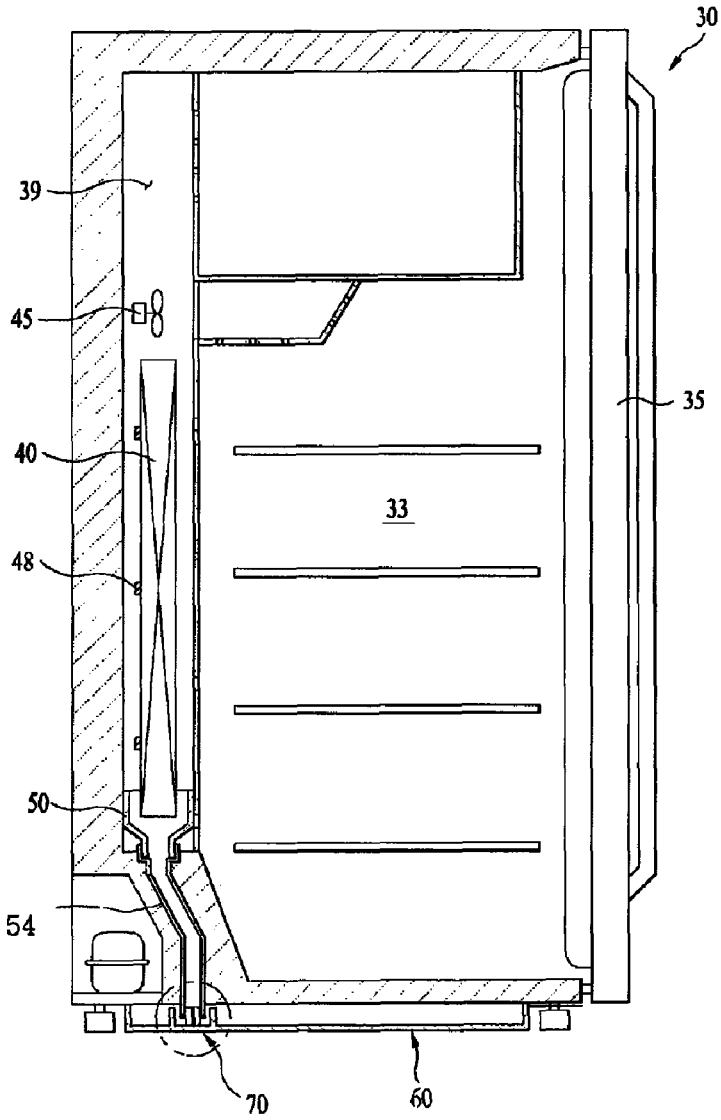
FIG. 2 is a side cross-sectional view of a refrigerator having an outside air-blocking structure according to the embodiment of the present invention.

FIG. 2 shows a refrigerator having an outside air-blocking structure according to the embodiment of the present invention in a side cross-sectional view.

Referring to FIG. 2, the refrigerator 30 according to the embodiment of the present invention includes a main body 31 in which a storage chamber 33 is provided, a door 35 for opening/closing the storage chamber 33, a cold air producing chamber 39 provided at the rear of the storage chamber 33, an evaporator 40 accommodated in the cold air producing chamber 39, and a cooling fan 45 for transferring cold air produced in the evaporator 40 to the storage chamber 33. Further, a defrost heater 48, operated to remove formed on a surface of the evaporator 40, is provided at a side surface of the evaporator 40.

In detail, a drain pan 50, which is to receive defrost water generated while operating the defrost heater 48 or condensed water generated on the surface of the evaporator 40, is provided below the evaporator 40. And, a drain hose 54 for transferring defrost water to a bottom is extended at a lower part of a neck of the drain pan 50.

Also, a collecting tray 60, which collects defrost water discharged through the drain hose 54, is mounted below the main body 30. In detail, a blocking element 70, which supports the drain hose 54 and prevents outside air from introducing into the drain hose 54, is provided at the bottom of the collecting tray 60.

Figure 3:
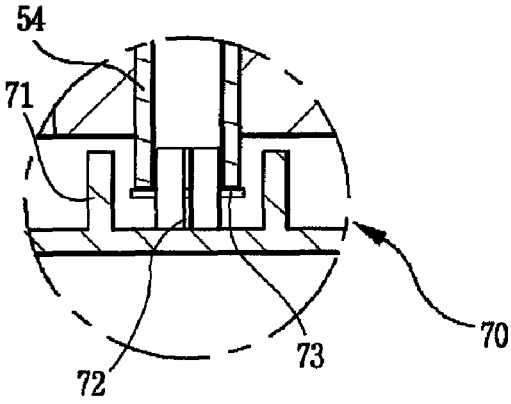
FIG. 3 is a partial cross-sectional view showing a blocking element of the refrigerator according to the embodiment of the present invention.
Figure 4:
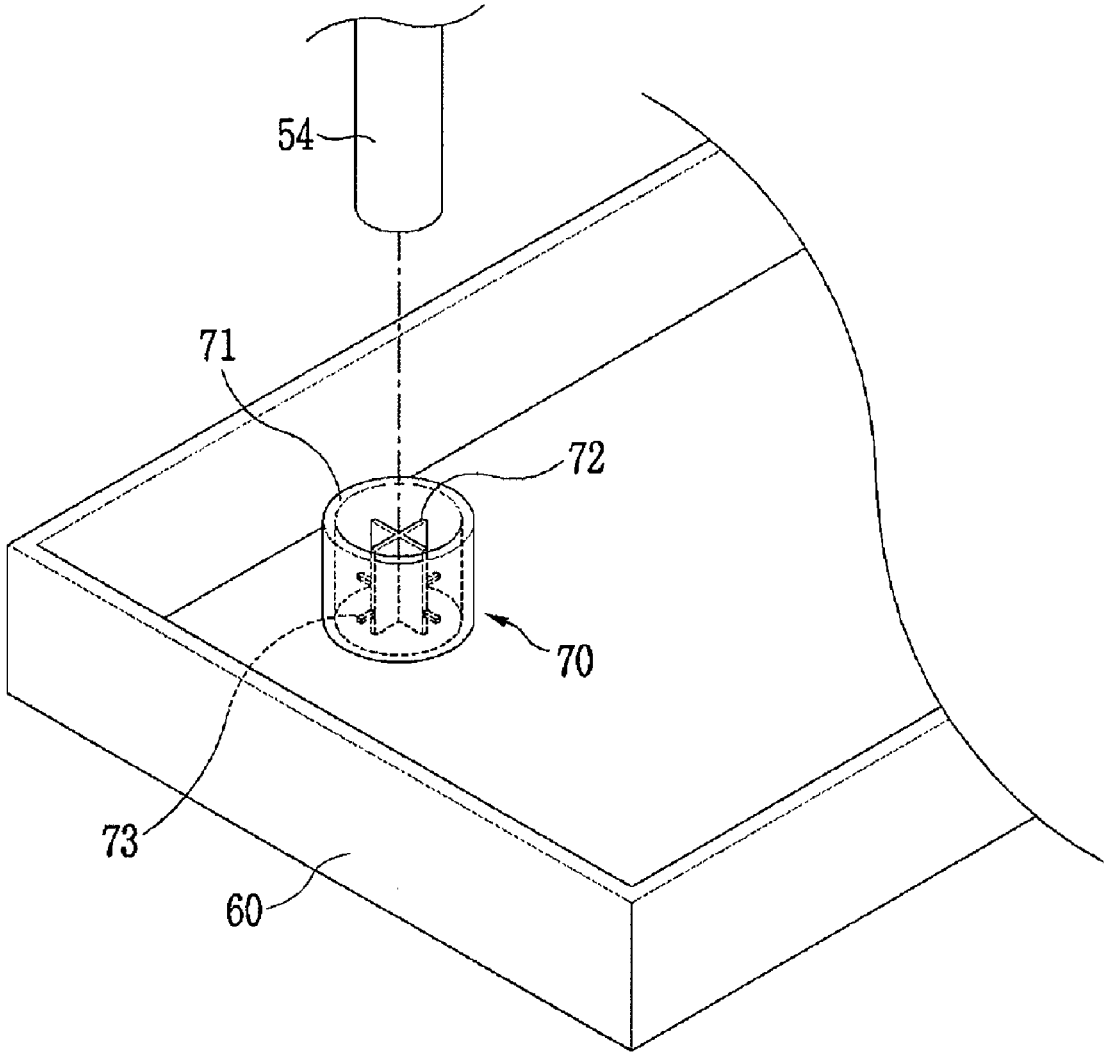
FIG. 4 is a perspective view showing a state before a drain hose according to the embodiment of the present invention is connected to the blocking element.
Figure 5:
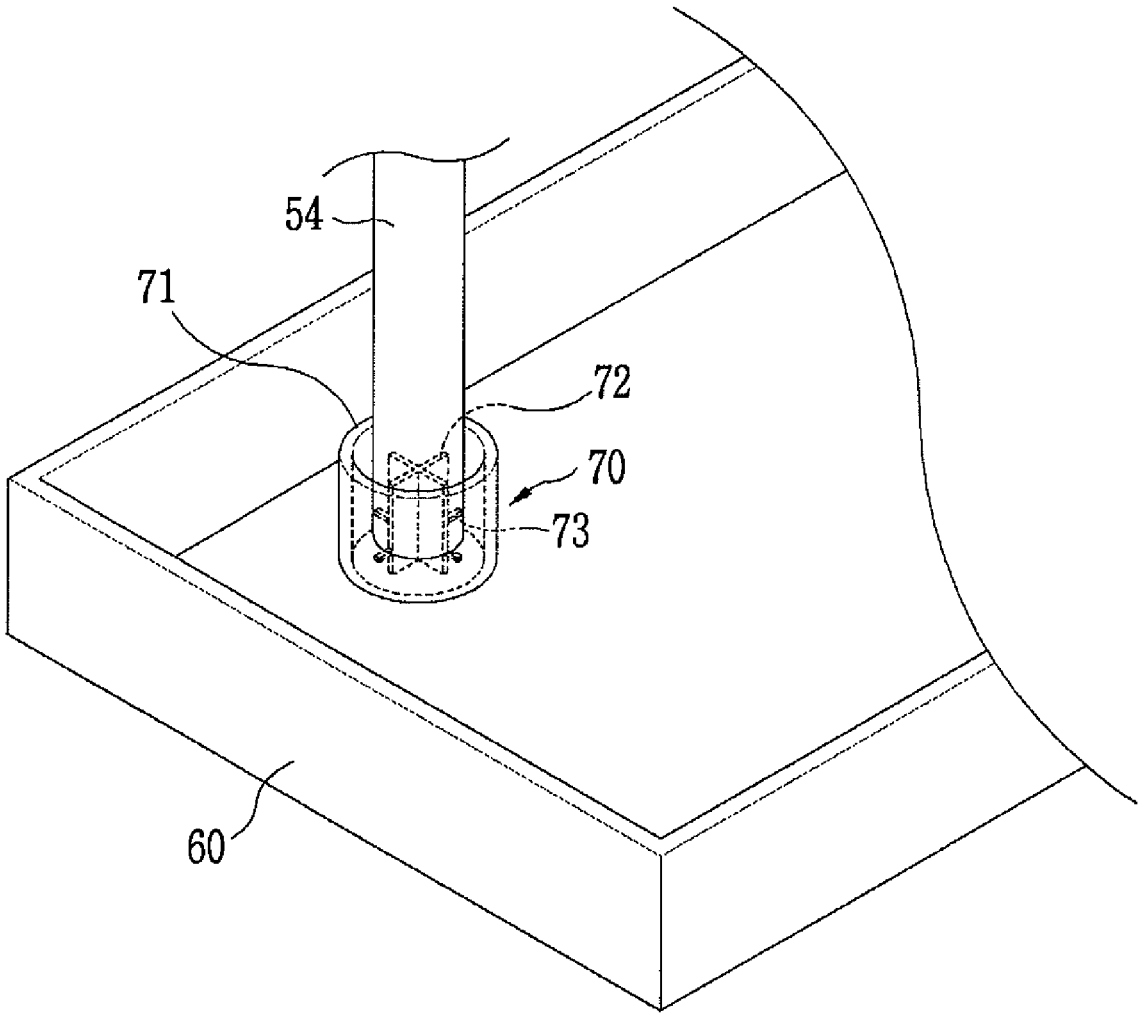
FIG. 5 is a perspective view showing a state where the drain hose is connected to the blocking element.

FIG. 3 shows a blocking element of the refrigerator according to the embodiment of the present invention in a partial cross-sectional view, FIG. 4 shows a state before a drain hose according to the embodiment of the present invention is connected to the blocking element in a perspective view, and FIG. 5 shows a state where the drain hose is connected to the blocking element in a perspective view.

Referring to FIGS. 3 to 5, the blocking element 70 according to the embodiment of the present invention includes a sleeve 71 upwardly extended from the bottom of the collecting tray 60, a support rib 72 provided inside the sleeve 71, and a support projection 73 horizontally extended from a side end of the support rib 72.

Specifically, the sleeve 71 is an element of a hollow cylinder shape, into which an end of the drain hose 54 is inserted. And, the sleeve 71 is configured that an inner diameter thereof is greater than an outer diameter of the drain hose 54. And then, defrost water falling along the drain hose 54 is collected at the sleeve 71, and water level rises along the space formed between an outer circumferential surface of the drain hose 54 and an inner circumferential surface of the sleeve 71. And, if defrost water overflows after the water level reaches a top of the sleeve 71, the water is collected onto the collecting tray 60.

Meanwhile, the support ribs 72 are configured that they are upwardly extended from the bottom of the collecting tray 60 and that at least two plates are extended in the intersecting direction each other. Therefore, each of the support ribs 72 is configured to be extended radially at a predetermined angle from the intersecting point. And, the width of the support rib 72 is equal to or smaller than the inner diameter of the drain hose 54, so that it can be inserted into the drain hose 54. In detail, as the support rib 72 is inserted into the drain hose 54, the fluctuation of the drain hose 54 is prevented.

Also, a plurality of support projections 73 are horizontally extended from a side end of the support ribs 72, and a lower end of the drain hose 54 is seated on the support projections 73. Here, the number of the support projections 73 may be the same as that of the support ribs 72. And, the support ribs 72 are formed at a height spaced from the bottom of the collecting tray 60 at a predetermined distance. If the lower end of the drain hose 54 is tightly connected to the bottom of the collecting tray 60, defrost water falling through the drain hose 54 cannot be filled into the sleeve 71. And then, the falling defrost water may be collected in the drain pan 50 as being filled in the drain hose 54, and over time, the bottom of the evaporator 40 may be immersed in the defrost water. Therefore, the drain hose 54 is needed to be spaced apart from the bottom of the collecting tray 60 so that the falling defrost water is freely stored in the sleeve 71 and is finally stored in the collecting tray 60.

Further, an end of the drain hose 54 is inserted into the sleeve 71, as the support projections 73 are formed at a lower level than a top of the sleeve 71.

Figure 6:
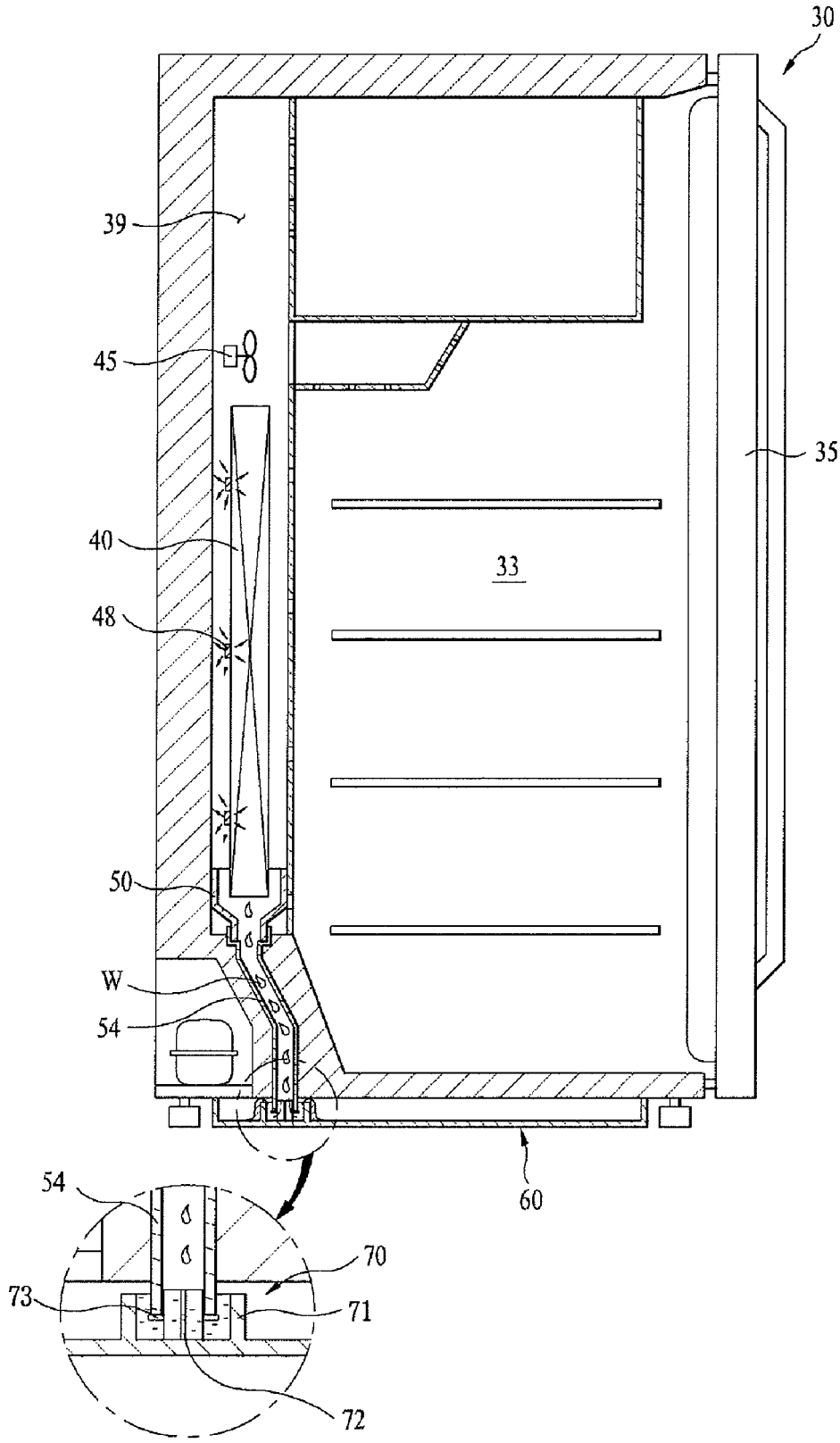
FIG. 6 is a view showing a condition where outside air is prevented from introducing into a cold air producing chamber by the blocking element according to the embodiment of the present invention.

FIG. 6 shows a condition where outside air is prevented from introducing into a cold air producing chamber by the blocking element according to the embodiment of the present invention.

Referring to FIG. 6, if the defrost operation for removing frost attached on the surface of the evaporator 40, refrigerant is stopped from flowing into the evaporator 40. Further, the cooling fan 15 is stopped, and the defrost heater 48 is operated to diffuse heat. And then, the frost formed on the surface of the evaporator 40 is melt and turned into defrost water W.

In detail, the defrost water W is collected into the drain pan 50 and is dropped into the collecting tray 60 along the drain hose 54. Further, the defrost water W falling along the drain hose 54 is stored in the sleeve 71. Here, since a space is formed between adjacent support ribs 72, the falling defrost water W is freely collected in the sleeve without flow resistance.

Meanwhile, water level of the defrost water W stored in the sleeve 71 is raised, and the water level W is overflowed when reaching a top of the sleeve 71. And, since the lower end of the drain hose 54 is disposed at a level which is lower than the sleeve 71, an end of the drain hose 54 is immersed in the defrost water. In that case, outside air is prevented from introducing into the drain hose 54 via an outlet of the drain hose 54. Here, a point of time when the drain hose 54 is closed is determined according to a formation position of the support projection 73 which supports the lower end of the drain hose 54. For example, if the support projection 73 is formed adjacent to the bottom of the collecting tray 60, the point of time when the drain hose 54 is immersed into water will be accelerated, however if the support projection 73 is formed apart from the bottom of the collecting tray 60, the point of time when the drain hose 54 is immersed into water will be delayed.

Meanwhile, if the defrost operation is completed, cold refrigerant is reflowed into the evaporator 40 to produce cold air, and the cold air is moved to the storage chamber 33 as the cooling fan 45 rotates.

Once the drain hose 54 is immersed into the sleeve 71, outside air cannot be introduced into the drain hose 54 before the level of water stored in the sleeve 71 is lowered to a certain point lower than the support projection 73.

By means of this construction, since outside air is effectively prevented from being introduced therein through the drain hose 54, it is possible to prevent the phenomenon that water vapor is condensed at the outlet of the drain pan 50 and prohibits frost water from being discharged.

What is claimed is:

1. A refrigerator, comprising:

a main body in which a food storage chamber is provided;

a door pivotably provided at a front of the main body to selectively open/close the storage chamber;

an evaporator installed at a rear of the storage chamber;

a drain pan provided below the evaporator to receive condensed water;

a collecting tray provided at a bottom of the main body to store condensed water collected in the drain pan;

a drain hose extended from the drain pan to guide condensed water to the collecting tray; and a blocking element into which an outlet end of the drain hose is inserted to prevent outside air from being introduced into the drain hose, wherein the blocking element comprises:

a sleeve extended a predetermined length from a bottom of the collecting tray;

a support rib extended from the bottom of the collecting tray in an inner portion of the sleeve and configured that a plurality of plates are extended in an intersecting direction from each other; and a support projection protruded from a side end of the support rib.

2. The refrigerator according to claim 1, wherein an inner diameter of the sleeve is greater than an outer diameter of the drain hose.

3. The refrigerator according to claim 1, wherein the support rib is inserted into the drain hose.

4. The refrigerator according to claim 1, wherein a width of the support rib is equal to or smaller than an inner diameter of the drain hose.

5. The refrigerator according to claim 1, wherein the support rib is configured that a plurality of plates are extended radially at a predetermined angle from the intersecting point.

6. The refrigerator according to claim 1, wherein an outlet end of the drain hose is seated on the support projection.

7. The refrigerator according to claim 1, wherein the support projection is formed at a portion which is predetermined distance apart from the bottom of the collecting tray.

8. The refrigerator according to claim 1, wherein the support projection is formed at a portion which is lower than a top of the sleeve.

9. The refrigerator according to claim 1, wherein the number of the support projections is the same as that of the support ribs.

10. A refrigerator, comprising:

a main body where a machine room for accommodating a compressor and a condenser is provided at a bottom portion;

an evaporator provided in the main body to produce cold air;

a drain pan provided below the evaporator to receive condensed water;

a collecting tray provided at a bottom portion of the machine room to store condensed water collected in the drain pan;

a drain hose extended from the drain pan to guide condensed water to the collecting tray; and a blocking element protruded at a bottom of the collecting tray to collect the condensed water, wherein an outlet end of the drain hose is immersed into the condensed water which is collected in the blocking element to prevent outside air from being introduced into the evaporator, and wherein the blocking element comprises:

a sleeve extended a predetermined length from a bottom of the collecting tray;

a support rib extended from the bottom of the collecting tray in an inner portion of the sleeve and configured that a plurality of plates are extended in an intersecting direction from each other; and a support projection protruded from a side end of the support rib.

* * * * *